United States Patent [19]

Nitteberg

[11] 4,196,771

[45] Apr. 8, 1980

[54] VENTILATOR WITH HEAT EXCHANGER

[75] Inventor: Per Nitteberg, Ås, Norway

[73] Assignee: A/S Norlett, Askim, Norway

[21] Appl. No.: 832,410

[22] Filed: Sep. 12, 1977

[51] Int. Cl.[2] ..... F28D 19/00

[52] U.S. Cl. ..... 165/7; 165/8; 165/10; 165/72

[58] Field of Search ..... 165/6, 7, 8, 10

[56] References Cited

U.S. PATENT DOCUMENTS

| | | | |
|---|---|---|---|
| 1,560,271 | 11/1925 | Lynger | 165/8 |
| 1,843,252 | 2/1932 | Toensfeldt | 165/7 |
| 2,227,836 | 1/1941 | Linderoth | 165/7 X |
| 2,911,197 | 11/1959 | Scherenberg | 165/8 X |
| 3,456,718 | 7/1969 | De Fries | 165/10 |

*Primary Examiner*—Albert W. Davis, Jr.
*Attorney, Agent, or Firm*—Young & Thompson

[57] ABSTRACT

A ventilator having a rotating drumlike heat exchanging fan and a housing with separation walls and a stationary conical member arranged in the hollow of the fan. Separation walls cooperating with external and internal sides of the fan have lips arranged according to the specification.

4 Claims, 5 Drawing Figures

VENTILATOR WITH HEAT EXCHANGER

The present invention relates to a ventilator with a heat exchanger, in the form of a rotating drumlike fan and a housing which is externally closed and has at least one inlet opening on the suction side and at least one outlet opening on the pressure side.

U.S. Pat. No. 3,456,718 shows such a ventilator in which at least on plain separation wall between two inlet openings on the suction side extends into the hollow of the fan. This generates turbulence which decreases the efficiency of the ventilator. The effective part of the fan consists of organic foam, usually foam plastic, of which the diaphragm faces are removed by aftertreatment. This results in a heat exchanging body with a great number of narrow channels which are easily clogged by the presence of fine particles in the medium to be ventilated. Further the organic foam will easily be damaged by great rotational speed of the fan.

The primary object of the invention is to provide new and more effective separation between the suction and pressure sides in the ventilator and a heat exchanging fan, the material and construction of which are such that the above mentioned drawbacks are avoided.

This is according to the invention achieved in that the housing comprises a border and two end plates, which border is divided by a first separation wall, extending parallel to the end plates, between the suction side and the pressure side and at a distance from the end plates, and having a central opening with a diameter which approximates the internal diameter of the exchanger and receives a fixed, hollow and conical member which with its open end with the greater diameter extends upwards into the central hollow of the exchanger, and the closed end of which with its smaller diameter is tightly connected to a second separation wall between two groups of inlets on that side of the first separation wall which does not receive the exchanger, which second separation wall extends upwards over the first separation wall, along opposite sides of the external wall of the conical member and forms a first pair of lips against the internal side of the exchanger, which lips extend to the same side of the second separation wall, and on the pressure side of the first separation wall are formed a second pair of lips which from opposite sides of the internal wall of the border extends tangentially against the external side of the exchanger, which second pair of lips extend against the rotational direction of the exchanger, such that one lip of the first pair and one lip of the second pair are facing each other diametrically and the second lip of the first pair and the second lip of the second pair are displaced in the rotational direction of the exchanger from the internal side of the exchanger to the external side thereof.

Preferably at least one inlet on the suction side extends from the lower side of the first separation wall over the upper end plate of the housing and has a removable cover for cleaning of a suction channel which is connected to the said inlet.

The rotating heat exchanging fan is preferably a drum built of a stack of annular plates of metal, such as aluminum, of which every second plate is corrugated in the circumferential direction and forms a spacer between two flat annular plates, which annular plates, alternately flat and corrugated, are connected to each other and to a circular plate for rotatable bearing of the drum.

One embodiment of the invention will be described in more detail below, with reference to the drawings.

Figure 1:
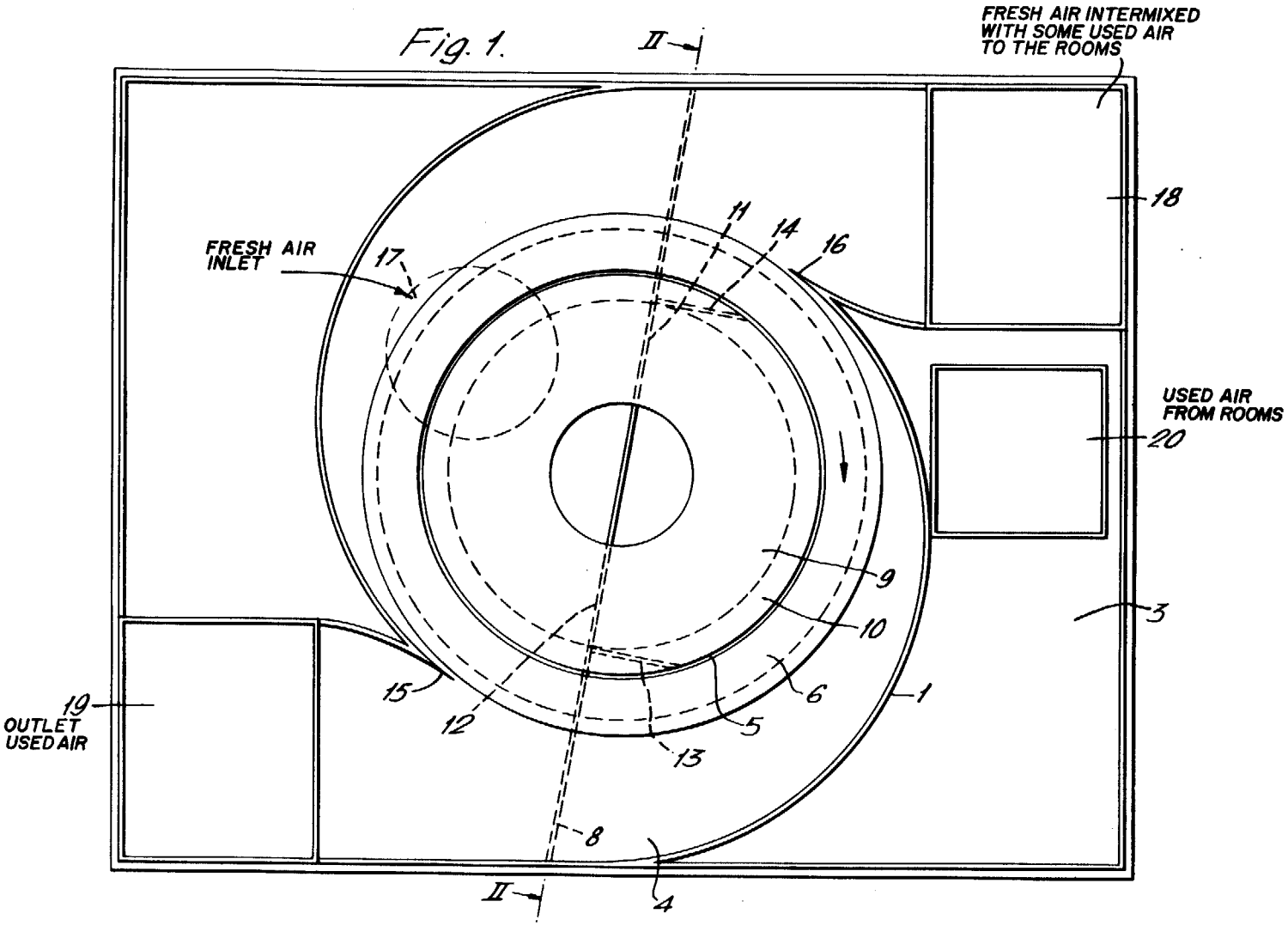
FIG. 1 shows diagrammatically a plan view of a ventilator according to the invention with the upper end plate removed.
Figure 2:
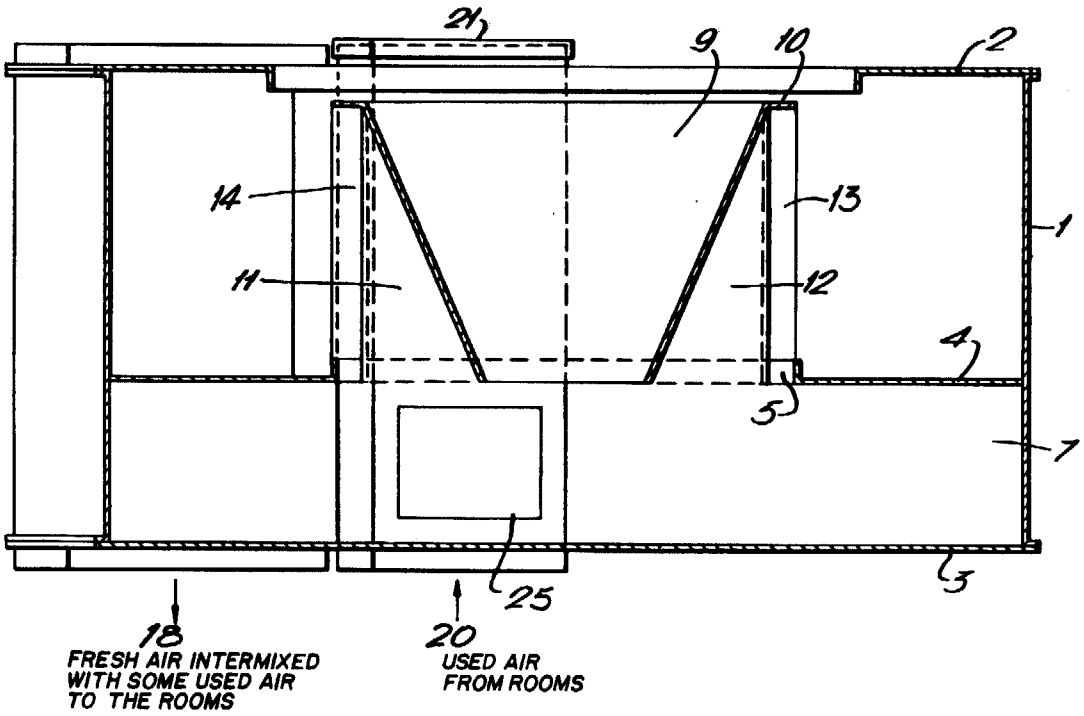
FIG. 2 shows diagrammatically a cross-sectional view along the line II—II in FIG. 1.

The ventilator comprises a scroll 1 and two end plates 2 and 3 parallel to the edges of the scroll. The edges of the scroll have outwardly extending flanges to which the end plates are spotwelded. The scroll 1 is divided by a first separation wall 4 parallel to and at a distance from the end plates 2 and 3, between the suction side and the pressure side. The first separation wall 4 has a central opening 5 with a diameter which approximates the internal diameter of the fan drum 6. The suction side 7 between the first separation wall 4 and the lower end plate 3 is provided with a second separation wall 8 which extends closingly between opposite border walls diametrically to the opening 5 and is in this opening connected to the closed end with the smaller diameter of a conical member 9 of which the open end with the greater diameter extends upwards through the opening 5 and into the hollow central part of the fan drum 6. The open end of the conical member 9 has an outwardly extending flange 10 with a diameter which approximates the internal diameter of the fan drum. The second separation wall 8, extends upwards through the opening 5 into the pressure side between the first separation wall 4 and the upper end plate 2 along diametrically opposite sides of the conical member 9 with parts 11 and 12 which are bent tangentially along the edge into a first pair of lips 14 and 13 respectively against the internal side of the fan drum flush with the outer edge of the flange 10 and to the same side of the first separation wall 4. On the pressure side between the first separation wall 4 and the upper end plate 2 are further arranged a second pair of lips 15 and 16 which extend outwardly on opposite sides of the border wall and tangentially to the circumference of the fan drum 6 against the rotational direction thereof, such that the ends of the lips 14 and 16 lie radially opposite each other and pointing in opposite directions. The lips 13 and 15 are displaced from each other at an angle of for instance 60° in the rotational direction and point in the same direction. Guiding members between the suction side, namely the conical member 9, the parts 11 and 12 of the first separation wall 4 and the lips 13 and 14, and the lips 15 and 16 on the pressure side, and the mutual position of the lips substantially decreases turbulence and increases the desired infiltration of fresh air from the inlet 17 on the pressure side in the lower end plate 3 and to the outlet 18 for fresh air intermixed with some used air and used air is leaving the outlet 19. The fresh air inlet 17 is arranged on the suction side of the first separation wall 4 and on the one side of the second separation wall 8, and the exhaust, of which only one 20 is shown in the drawing, is arranged in the lower end plate 3 on the other side of the second separation wall 8. The exhaust 20 is formed as a through channel with an opening 25 into the suction side 7 and an open end which extends through the upper end plate 2 and is closed by a removable cover 21 to make cleaning from above possible, as it may be used for exhaust from a kitchen, which means deposition of grease on the channel wall.

Figure 3:
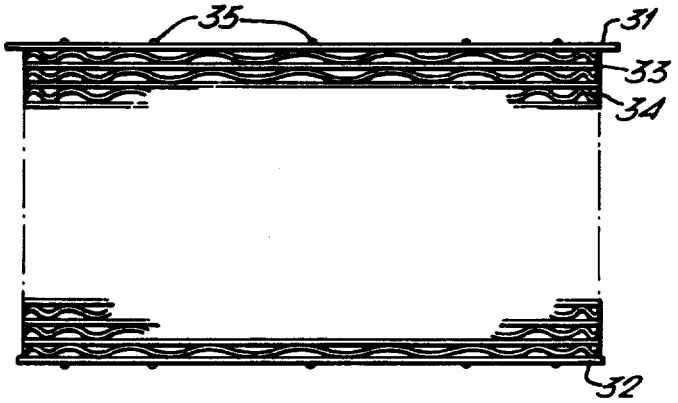
FIG. 3 shows diagrammatically a side view of a fan drum according to the invention.
Figure 4:
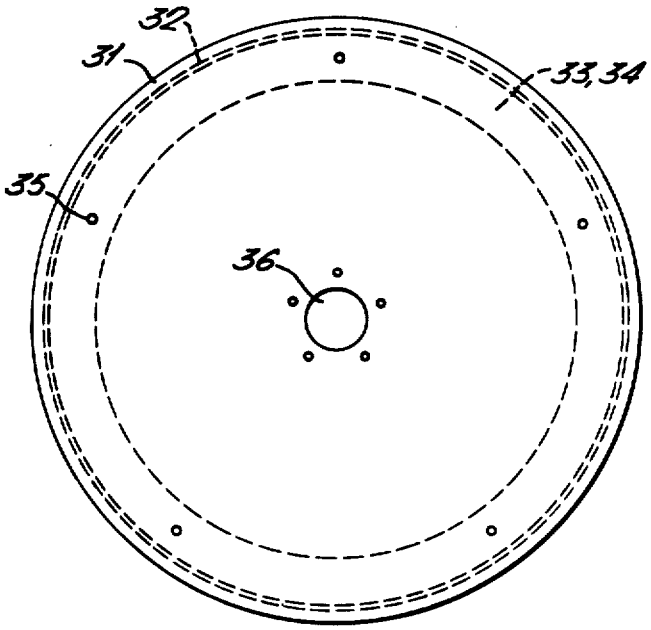
FIG. 4 shows diagrammatically a plan view of the fan drum in FIG. 3.
Figure 5:
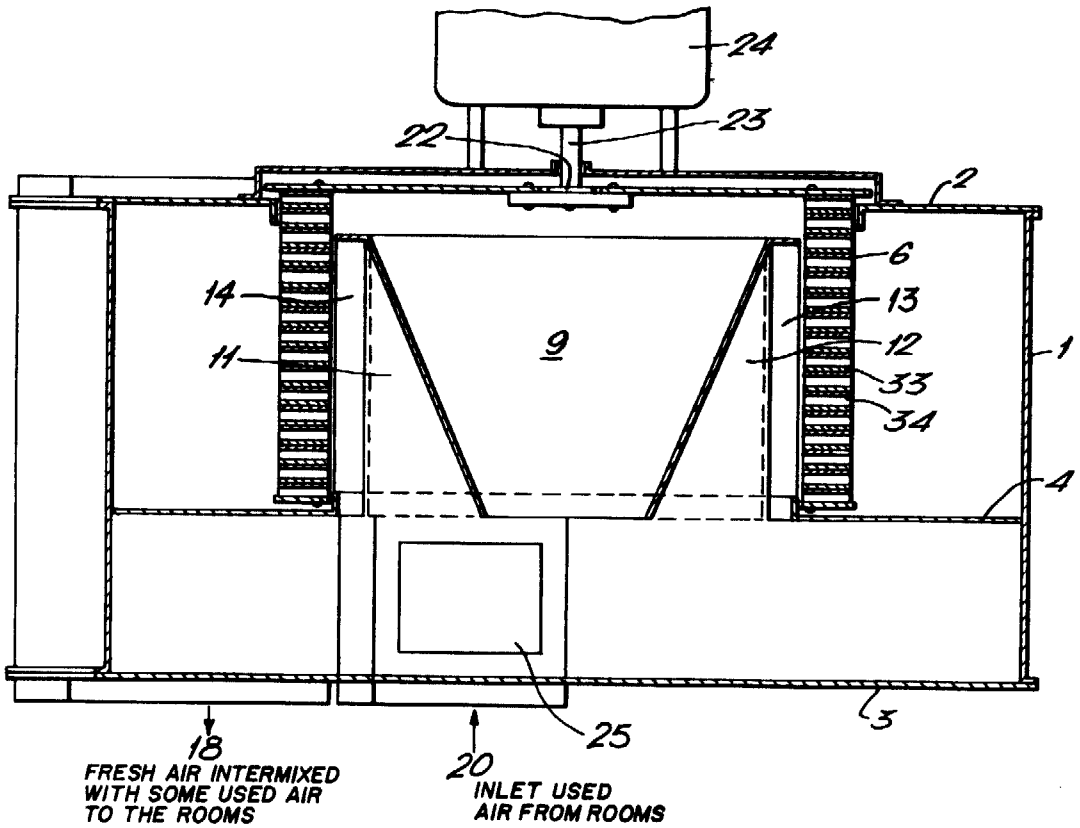
FIG. 5 shows diagrammatically the fan drum together with the driving motor mounted in the housing as shown in FIG. 2.

The fan drum in FIG. 3 and 4 consists of circular base 31 with a central opening 36 for a hub (22 in FIG. 5) to be fastened of the driving shaft (23 in FIG. 5) of an eletric motor (24 in FIG. 5). On the base 31 is fastened a stack of annular plates 32, 33 and 34 by means of through-going rivets 35. The annular plates are alternately flat 33 and corrugated 34 in the circumferential direction. The annular flat end plate 32 is thicker than the other annular plates and they are all of aluminium. The annular corrugated plates 34 serve as spacers for the flat plates 33 and form cavities which increase the air transport capacity and the heat exchange efficiency of the ventilator.

Having described my invention, I claim:

1. A ventilator with heat exchanger in the form of a rotating drum-like fan and a housing which is externally closed and has at least one inlet opening on the suction side and at least one outlet opening on the pressure side, and separation walls between the suction side and the pressure side, characterized in that the housing comprises a scroll and two end plates, which scroll is divided by a first separation wall, extending parallel to the end plates, between the suction side and the pressure side and at a distance from the end plates, and having a central opening with a diameter which approximates the internal diameter of the exchanger and receives a fixed, hollow and conical member which with its open end with the greater diameter extends upwards into the central hollow of the exchanger, and the other end of which with its smaller diameter is tightly connected to a second separation wall between two groups of inlets on that side of the first separation wall which does not receive the exchanger, which second separation wall extends upwards over the first separation wall, along opposite sides of the external wall of the conical member and forms a first pair of lips against the internal side of the exchanger, which lips extend to the same side of the second separation wall, and on the pressure side of the first separation wall are formed a second pair of lips which from opposite sides of the internal wall of the scroll extend tangentially against the external side of the exchanger, which second pair of lips extend against the rotational direction of the exchanger, such that one lip of the first pair and one lip of the second pair are facing each other diametrically and the second lip of the first pair and the second lip of the second pair are displaced in the rotational direction of the exchanger from the internal side of the exchanger to the external side thereof.

2. A ventilator according to claim 1, characterized in that at least one inlet on the suction side extends from the lower side of the first separation wall up over the upper end plate of the housing and has a removable cover for cleaning of a suction channel which is connected to the said inlet.

3. A ventilator according to claim 1, characterized in that the rotating heat exchanger is a drum comprising a stack of annular plates of metal which are alternately flat and corrugated, which annular plates are connected to each other and to a circular plate for rotatable bearing of the drum.

4. A ventilator according to claim 3, characterized in that the flat and corrugated annular plates and the circular plate are made of aluminium.

* * * * *